United States Patent [19]

Ellis, Jr.

[11] 4,266,399

[45] May 12, 1981

[54] METHODS OF AND APPARATUS FOR MAKING CABLE

[75] Inventor: Benjamin C. Ellis, Jr., Snellville, Ga.

[73] Assignee: Western Electric Company, Inc., New York, N.Y.

[21] Appl. No.: 63,009

[22] Filed: Aug. 2, 1979

[51] Int. Cl.[3] ..... H01B 13/04

[52] U.S. Cl. ..... 57/293

[58] Field of Search ..... 57/3, 13, 14, 15, 76, 57/77, 293, 294, 311, 312, 314, 352; 242/82, 83

[56] References Cited

U.S. PATENT DOCUMENTS

| | | | |
|---|---|---|---|
| 3,023,977 | 3/1962 | Whitacre | 242/82 |
| 3,187,495 | 6/1965 | Cristian | 57/213 X |
| 3,572,024 | 3/1971 | Lyons | 57/3 |
| 3,757,505 | 9/1973 | Neovius et al. | 57/293 X |
| 3,843,072 | 10/1974 | Rayfield | 242/82 |
| 3,884,025 | 5/1975 | Oberender et al. | 57/293 |
| 3,979,897 | 9/1976 | Vogelsberg et al. | 57/293 X |
| 4,056,925 | 11/1977 | Vogelsberg | 57/293 |
| 4,127,982 | 12/1978 | Braun et al. | 57/293 X |

*Primary Examiner*—Donald Watkins
*Attorney, Agent, or Firm*—E. W. Somers

[57] ABSTRACT

In the manufacture of a cable unit (30), which comprises a center portion and a plurality of layers of twisted conductor pairs, the pairs in the center portion and in each layer are oscillated in alternately opposite directions after which the unit is bound and taken up in a stationary container (62) by a system (100) which distributes the unit in a predetermined pattern of varying size convolutions. This distribution, which results in a dense package of a cable unit having a free end that facilitates testing of the unit during takeup, is accomplished while the speed at which the unit is being advanced and distributed into the varying size convolutions is maintained substantially constant.

20 Claims, 15 Drawing Figures

Fig. 5
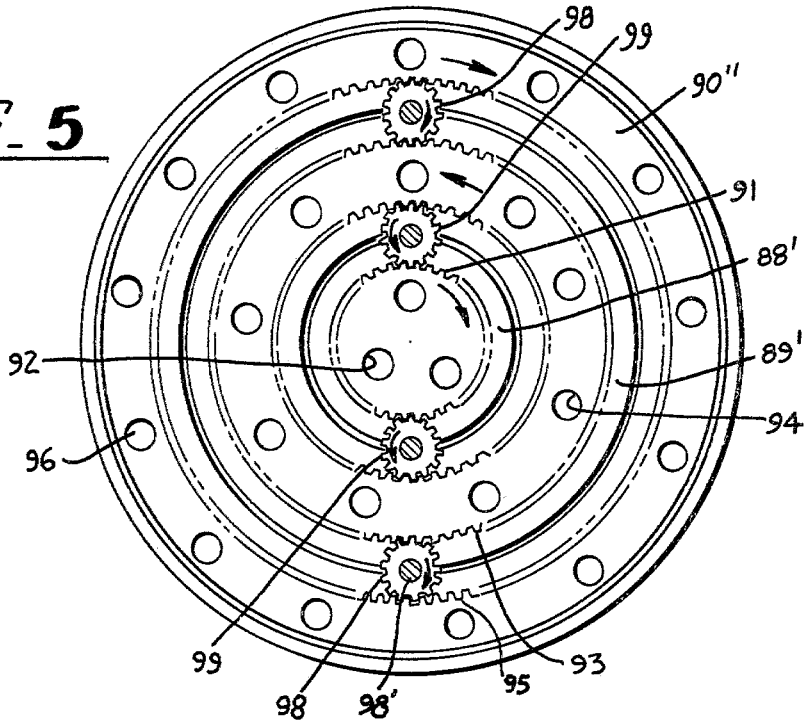
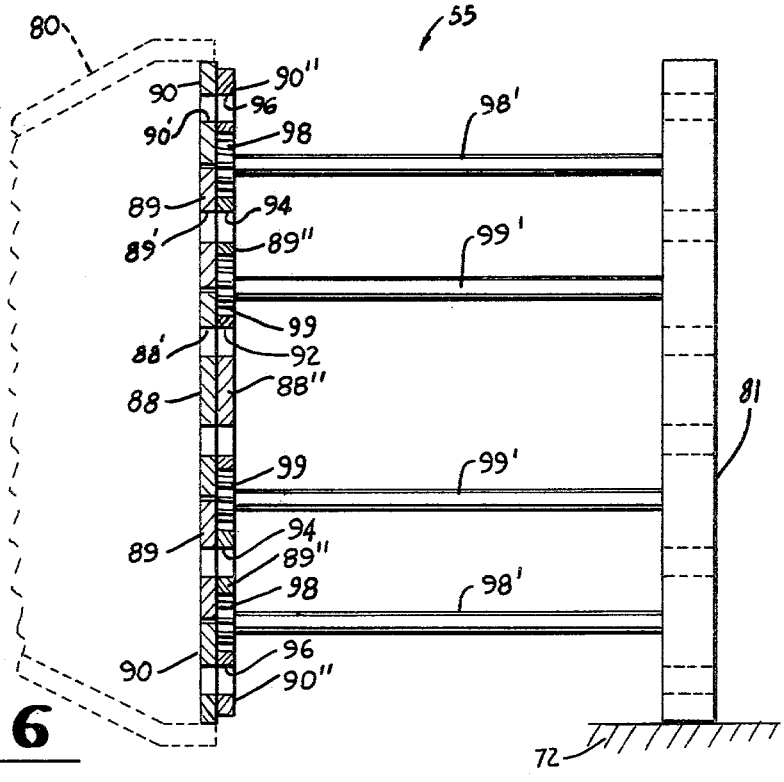
Fig. 6

METHODS OF AND APPARATUS FOR MAKING CABLE

TECHNICAL FIELD

This invention relates to methods of and apparatus for making cable, and, more particularly, to methods and apparatus for making communications cables in which a plurality of reverse oscillated layers of insulated conductors are assembled into a unit that is taken up in a stationary container and used as a supply in a subsequent stranding or cabling operation.

BACKGROUND OF THE INVENTION

In the manufacture of multi-pair telephone communications cables, it has been the usual commercial practice to strand already twisted pairs of conductors helically about a longitudinal axis. Two approaches to the manufacture of such cables are drum-stranding and unit stranding. In the former approach, a cable core is assembled on a strander having a drum in which supply reels of twisted conductor pairs are mounted. The drum is rotated as the conductor pairs are pulled from the supply reels onto a takeup reel so that a unidirectional twist called a stranding lay is imparted to the cable core. A plurality of drums may be placed in tandem to provide a required number of conductor pairs for a particular size cable with successive drums usually driven in opposite directions to apply the conductor pairs in layers in which the directions of the helix as between adjacent layers is reversed to impart desirable electrical characteristics to the cable.

Because of production limitations in cable size imposed by apparatus for drum stranding, unit type cable structures have generally replaced the drum-stranded layer type. In the unit type structure, the cable includes one or more bound, bundles of twisted pairs of conductors which are referred to as units and which are assembled in apparatus called flyer stranders. The stranding is accomplished by paying out the individual twisted pairs of conductors from supply reels mounted in stationary racks through apertured guides or unit faceplates and through stationary unit forming dies onto a reel which is rotated in a cradle to take up the twisted conductor pairs as a flyer bow is revolved about the cradle. In larger pair size cables, a plurality of units are assembled into a core in a rotating takeup apparatus which is referred to as a cabling machine.

Unit type cables have been formed with a so-called false or reverse stranding lay, that is, a lay that reverses direction periodically along the length of the cable. Individual units are formed by passing pairs through a faceplate which includes a plurality of openings that may be disposed in concentric circles consistent with a layering arrangement of conductor pairs of the cable design. In order to reduce crosstalk between adjacent units in a multiunit cable which is assembled in a cabling apparatus, the faceplate of each unit is oscillated through a predetermined angle in a predetermined length of unit. To maintain the reverse lay in the conductor pairs, they are bound together such as, for example, by a binder tape immediately upon emerging from a unit forming station.

Cable structures which are manufactured by the two aforementioned approaches differ in several important characteristics. The relative position of a conductor pair in one layer of a reverse layer, drum-stranded cable is continuously changing with respect to a conductor pair in an adjacent layer through each stranding lay. However, the relative positions between pairs in adjacent layers in a unit type cable structure remain substantially unchanged. This is of no consequence with respect to crosstalk between conductor pairs in the same layer because that is easily controlled by twist length selection. From the standpoint of crosstalk between conductor pairs, the reverse layer structure is more attractive because pairs exhibiting poor unbalances are not continuously exposed to each other along the length of the cable. Additionally, it has been shown that there is a tendency for conductor pairs to migrate and become displaced from an assigned position in unit type cable structures. This movement seemingly does not occur in reverse layer, drum-stranded cable. Another important difference appears to be that the space per pair or cross sectional area occupied by a pair of insulated conductors is greater for reverse-layer, drum stranded cable than for unit type cable which results in improved mutual capacitance for a reverse layer cable over that for a unit type.

It is beneficial to use the unit type approach with its capability of making larger pair size cables, while incorporating the desirable features of the drum stranding approach. For example, if the electrical characteristics of the unit type cable are satisfactory, the same space per pair with drum stranded cable as a unit type cable may be achieved with a smaller diameter-over-dielectric (DOD) of each insulated conductor. This would permit a reduction in the DOD with an accompanying reduction in the amount of insulation material.

In the prior art, it is known to assemble a plurality of layers, each of which has a plurality of cnductor pairs where the conductor pairs in at least one layer are parallel in the form of a helix having a direction of lay reversed periodically along its length and differing from the lay of conductors in an adjacent layer. The cable is made by arranging strand elements in concentric layers, reciprocatingly rotating the layers in alternately opposite directions, bringing the layers together and applying a constraining element around the outer layer. See for example, U.S. Pat. No. 3,187,495. The layers of reverse-oscillated pairs which simulates the effect of reverse layer, drum stranded cable may also be brought together, bound and taken up in a rotating takeup which imparts a stranding lay to the unit. In doing so, the stranding overcomes but is perturbated by the individual reverse twists imparted to each pair by the faceplates.

Problems in systems of the type just described include the rotation of a massive takeup, limitations on the length of cable imposed by the rotation of such a mass, and the inability to test the cable unit until after stranding. What is needed and what is not provided by the prior art are methods and apparatus for making oscillated layer cable which overcome these problems by forming each of the layers of a unit with an oscillated lay and for then taking up the units in a non-rotating takeup with provisions for testing the cable during manufacture and before payout to a stranding or cabling machine.

SUMMARY OF THE INVENTION

The foregoing problems of the prior art are overcome by the methods and apparatus of this invention for making cable in which each of a plurality of strand elements such as, for example, twisted insulated conductor pairs, is advanced through an associated opening of a plurality of spaced openings in a plate, said openings being arranged about a common axis. It is to be understood that the methods and apparatus of this invention are capable of assembling pairs or quads of insulated conductors as well as single conductors. After the strand elements have been advanced through the openings which are caused to reciprocally rotate about the common axis, the strand elements are gathered together in a unit. The unit is moved to a distribution plane above a takeup, which is a stationary container, after which successive increments of the unit are directed downwardly and caused to be deposited in the container in a predetermined pattern while the speed of the unit is maintained substantially constant.

In a preferred embodiment of the invention, each twisted pair of insulated conductors of a plurality of pairs is advanced through an opening in one of a plurality of concentrically disposed faceplates which are caused to reciprocally rotate in alternately reverse directions. The openings in the plates are formed so that the conductor pairs being advanced therethrough are arranged in concentrically disposed layers. The layers are gathered together and are bound in each of two directions. Successive increments of length of the unit are then moved downwardly to a position below a stationary container and a lay of one direction is imparted to the unit after which it is guided upwardly through the container, passed over a flyer-capstan at a constant speed and through a flyer distribution tube which directs the unit into the container. As the unit descends into the container, a lay of a direction opposite to said one direction is imparted to it so that a zero lay or layless cable unit is taken up. The flyer-capstan is controlled to cause the cable unit to be taken up in a plurality of convolutions in each successive increment of height of the container to produce a high density package of layless cable. This unit of layless cable is then supplied to a stranding or cabling machine in which it is stranded or cabled together with other units. A lay is imparted to the cable unit as it is withdrawn from the stationary takeup and subsequently, the single unit or multi-unit cable is jacketed with a plastic material.

BRIEF DESCRIPTION OF THE DRAWINGS

Other features of the present invention will be more readily understood from the following detailed description of specific embodiments thereof when read in conjunction with the accompanying drawings, in which:

FIG. 5 is another view of the face plates shown in FIG. 4 along with mechanisms for oscillating the plates;

FIG. 6 is a side elevational view of the plates of FIG. 5 and a mounting arrangement for same;

DETAILED DESCRIPTION

Figure 1:
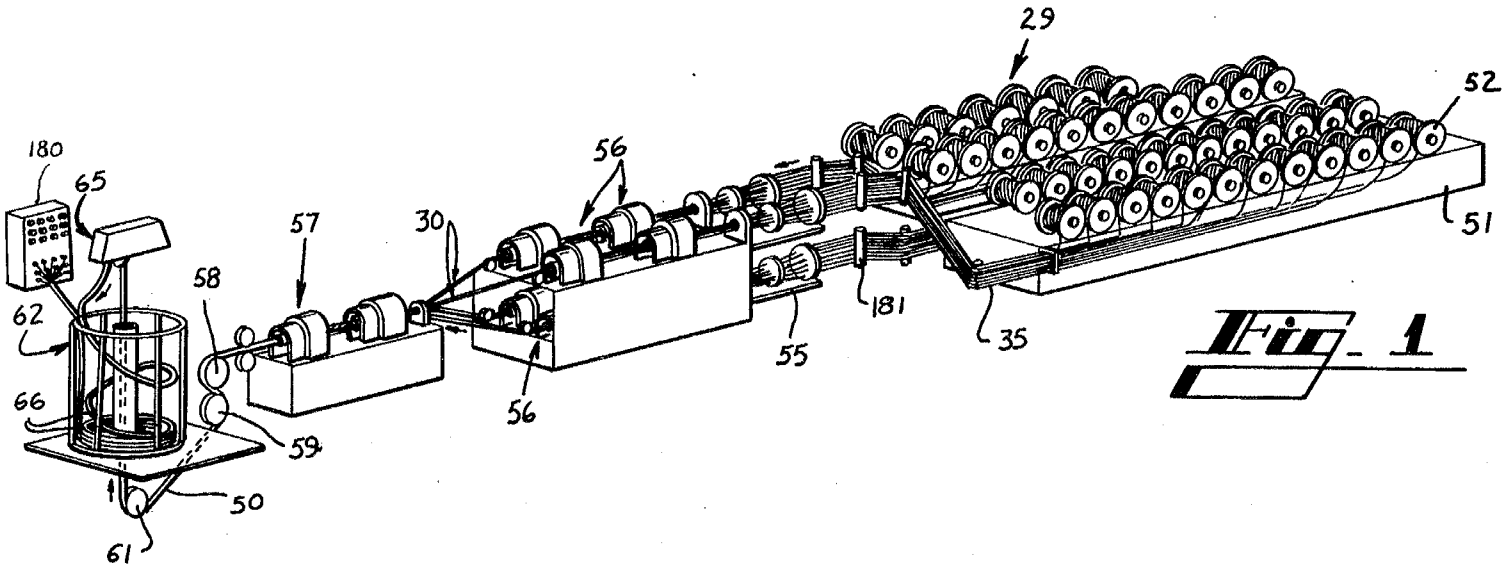
FIG. 1 is an overall perspective view of an apparatus of this invention for making a reverse oscillated layer multi-cable unit for use in making a communications cable.
Figure 2:
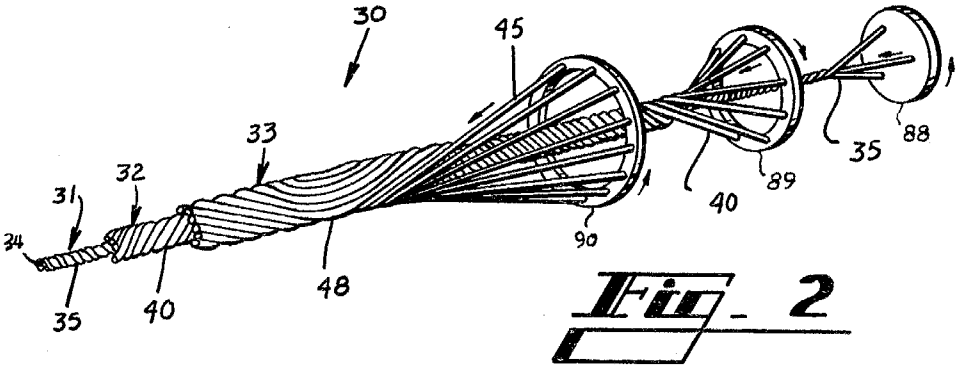
FIG. 2 is an enlarged perspective view of a portion of the apparatus of FIG. 1 and showing a portion of a three layer reverse oscillated layer cable unit which is formed thereby.

Referring now to FIGS. 1 and 2, there is shown an apparatus, designated generally by the numeral 29, for making reverse oscillated layer cable units 30—30 in accordance with this invention. Each unit 30 in a preferred embodiment is comprised of a center or core portion 31 and two concentric layers 32 and 33. The center portion 31 includes a plurality of twisted pairs 35—35 of insulated conductors 34—34 with each pair having a conventional twist, i.e. one direction twist along its entire length, or a so-called right hand-left hand (S-Z) twist, which may be made in accordance with methods and apparatus disclosed and claimed in copending, commonly assigned applications Ser. No. 957,772 in the names of J. M. Carter et al filed Nov. 6, 1978 and now U.S. Pat. No. 4,182,107 or Ser. No. 972,105 in the name of G. A. Scheidt filed Dec. 21, 1978 and now U.S. Pat. No. 4,214,432. Because the centers of the three pairs 35—35 which comprise the center portion 31 are disposed generally along the circumference of a circle, the center portion 31 is oft times referred to as a layer. A layer 32 which is applied over the center portion or layer 31 is comprised of a plurality of strands or conductor pairs 40—40 which are greater in number than the number of pairs 35—35 in the layer 31. For example, the inner layer 31 is typically comprised of three conductor pairs 35—35 while the layer 32 will have nine. Finally, the layer 33 is typically comprised of thirteen conductor pairs 45—45 so that the three layers form a twenty-five conductor pair unit.

Crosstalk is always likely to occur between two conductors in a communication cable that lie parallel and in proximity to each other. The likelihood of crosstalk between conductors in different layers and the center portion 31 is removed if they are twisted with opposite directions of lay.

The layer 32 is twisted with a lay in one direction followed by a reversal point and a length having a lay in the opposite direction. The layer 33 is constructed to have a right hand lay for a predetermined length followed by a left hand lay in the other direction for a predetermined length. Between the predetermined lengths, the strands or conductor pairs 45—45 of the layer 33 pass through a reversal point 48 whereat the direction of lay reverses. This pattern of twists, counter or reverse twists and reversal points is repeated periodically along the length of the cable in each of the layers and in the center portion 31. However, although the corresponding lays in adjacent layers are reversed in direction, an exact correspondence of reversal as between conductors in adjacent layers is not absolutely necessary to reduce crosstalk.

A first binder tape is wrapped about the unit 30 in one direction and a second binder tape is wrapped thereover in an opposite direction. The alternate bindings prevent the conductor pairs in the layers from coming out of their respective lay directions. The unit 30 is either jacketed or it is assembled together with a plurality of other similarly produced units to form a multi-unit cable.

Figure 1A:
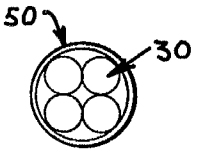
FIG. 1A is an enlarged end view of the multi-cable unit which is made by the apparatus of FIG. 1.

The apparatus 29 is capable of manufacturing a plurality of reverse oscillated layer cable units 30—30 which are assembled into a multi-unit core 50 shown in FIG. 1A. The apparatus 29 includes a plurality of pay off stands 51—51 each of which includes a plurality of individual reels 52—52 of twisted pairs of insulated conductors 35—35 or 40—40 or 45—45. As will be recalled, these may be either unidirectionally twisted pairs or those having a so-called S-Z twist. Predetermined groups of the conductor pairs 35—35 are moved through an associated one of a plurality of devices designated reverse oscillated lay (hereinafter referred to as "ROL") devices and further designated generally by the numeral 55. Each of the devices 55—55 produces a multi-layer unit 30 which is then advanced through a binder 56 that applies a first and second binder to each unit. The bound units 30—30 are then advanced through an overlay binder 57 that binds them together into the multi-unit core 50.

It should be understood that while FIG. 1 shows a plurality of pay-off stands and a plurality of ROL devices 55—55, the invention in a more basic embodiment would include one ROL device for producing a three layer unit having three, nine and thirteen conductors, respectively, in the three layers.

From the binders 56 and 57, the multi-unit or single unit cable is advanced past sheaves 58 and 59 thence past sheave 61 up through a center passage of a takeup in the form of a stationary container 62. As successive increments of the length of the unit 30 are moved past the sheave 61 and vertically upward, a right hand twist is imparted thereto.

The cable unit 30 is then moved through a flyer capstan, designated generally by the numeral 65, which causes it to be deposited within the container 62 in a plurality of increments 66—66 of height in convolutions of varying size while a substantially constant line speed is maintained. As this is done, a left hand twist is imparted thereto which neutralizes the priorly imparted right hand twist and results in a "dead" cable being arranged within the barrel.

The substantially constant line speed is advantageous in that expensive synchronization of take-up and supply stand motors is avoided. Moreover, speed changes which are obviated by this invention could cause a pull out of the reverse lay within the layers.

Subsequently, the container 62 is moved to another location and the unit 30 or multiunit 50 is payed out to be cabled with other units or multiunits. As this is done, a unidirectional lay is imparted to the unit and each conductor pair thereof.

Figure 3:
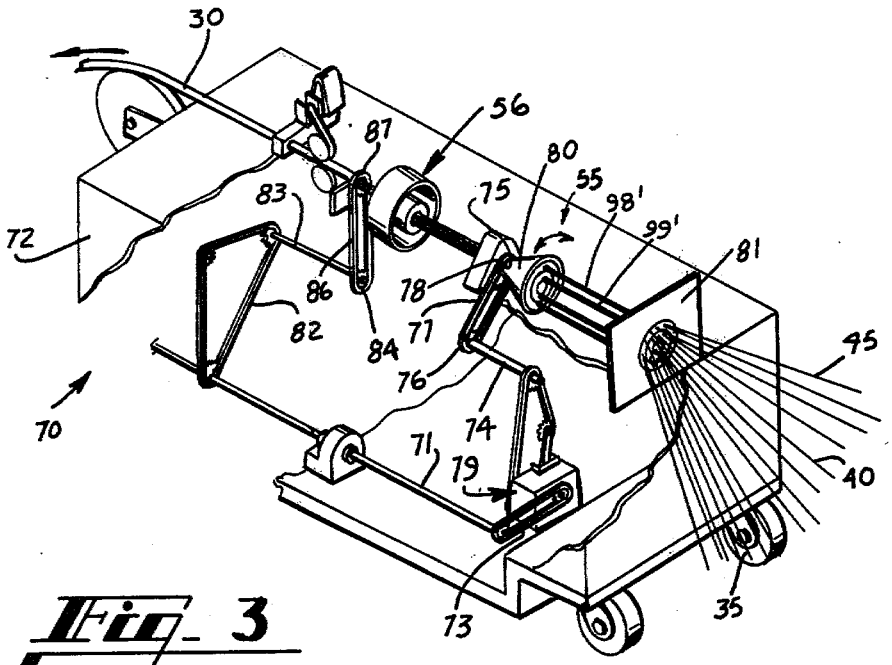
FIG. 3 is a perspective view of a portion of the apparatus shown in FIG. 1 which includes a reverse oscillated layer device for forming a cable unit.

FIG. 3 shows a portable means 70 for supporting one of the reverse oscillating layer devices 55—55 as well as a binder and footage counter. Because it is portable, the means 70 as well as other cable-making apparatus may be integrated into a line to produce a particular type cable. A line shaft 71 extends along in a housing 72 and includes a drive train 73 for turning a shaft 74 that has a sprocket 76 at one end thereof. A chain 77 passes around the sprocket 76 and is mounted to a sprocket 78 which is attached to a drive shaft 75, that is connected through a conically shaped member 80 to the ROL device 55. Reverse oscillation of the member 80 and of the ROL device 55 in FIG. 1 is caused by a commercially available, well known Scotch Yoke mechanism 79 which is interposed between the shafts 71 and 74. As can be seen in FIG. 3, the conductor pairs 35—35, 40—40 and 45—45 are passed from the supply stands 51—51 through openings in stationary plate 81 which is mounted on the housing 72 and then through an associated ROL device 55.

Another end of the line shaft 71 has a pulley and belt arrangement 82 for imparting rotary motion to a shaft 83 which turns a pulley 84 to move a belt 86 and pulley 87 to turn the head 56 to bind the unit 30.

Figure 4:
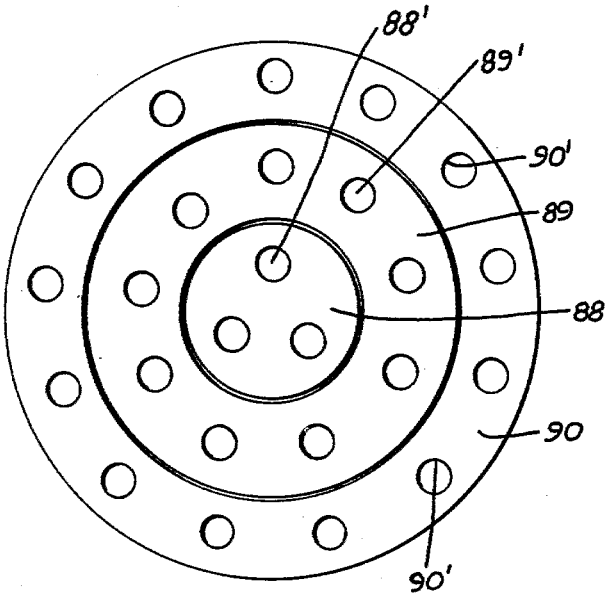
FIG. 4 is an end view of a plurality of concentrically disposed faceplates which comprise the reverse oscillated layer device of FIG. 2.

FIG. 4 shows an ROL device 55 for forming the three layer unit 30. Each of three concentrically disposed plates 88, 89 and 90 includes a plurality of guides in the form of openings 88'—88', 89'—89' and 90'—90', respectively. A conductor pair 35 is passed through each of the openings 88'—88', a pair 40 through each of the openings 89'—89' and a pair 45 through each of the openings 90'—90'. Each of the openings 88'—88', 89'—89' and 90'—90' typically is about 1.0 cm in diameter; of course, when the ROL device 55 is used to lay up twenty-five pair units, for example, instead of twisted pairs, the size of each opening is on the order of 3.2 cm.

In FIGS. 5 and 6, there is shown an arrangement for causing reverse oscillation, i.e. reciprocating rotation in alternately reverse directions of the plates 88, 89, and 90 of the ROL device 55. A plate 88'' which is associated with and attached to the plate 88 is constructed with a plurality of teeth 91 about an outer periphery and a plurality of openings 92—92 which are aligned with the openings 88'—88' in the plate 88. The plate 89 has an associated ring plate 89'' which has a plurality of teeth 93—93 formed about an outer and an inner periphery thereof and a plurality of openings 94—94 which are aligned with the openings 89'—89' in the plate 89. Similarly, a plate 90'' is associated with and attached to the plate 90' and has a plurality of peripherally disposed teeth 95 and a plurality of openings 96—96 which are aligned with the openings 90'—90'. The member 80 which is attached to the drive shaft 75 (see also FIG. 6) is also attached to outer portions of the ring plate 90 and causes, for example, an initial clockwise motion of the ring plate 90 which rotates a pinion 98 clockwise to drive the inner ring plate 89 counterclockwise. This turns a pinion 99 counterclockwise to turn the inner plate 88 clockwise. The overall effect is three concentrically disposed plates with adjacent plates being oscillated in opposite directions. In the alternative, a pinion (not shown) could be meshed with the ring plate 90 and connected to the shaft 75 which is turned to oscillate the ring plates in alternating opposite directions.

It should be apparent that it is within the scope of this invention to oscillate the plates 88, 89 and 90 through different angles to further vary the lay as between the conductors in the three layers. It should also be apparent that it is within the scope of this invention to advance all of the conductor pairs which are to be formed into a unit through one oscillating plate.

As can be seen in FIG. 6, each of the pinions 98 and 99 is attached to an associated rod 98' and 99', respectively, which are mounted in and extend from the stationary plate 81. In this way, the entire assembly of faceplates and driving mechanisms is supported from the plate 81 and hence from the housing 72.

Figure 7:
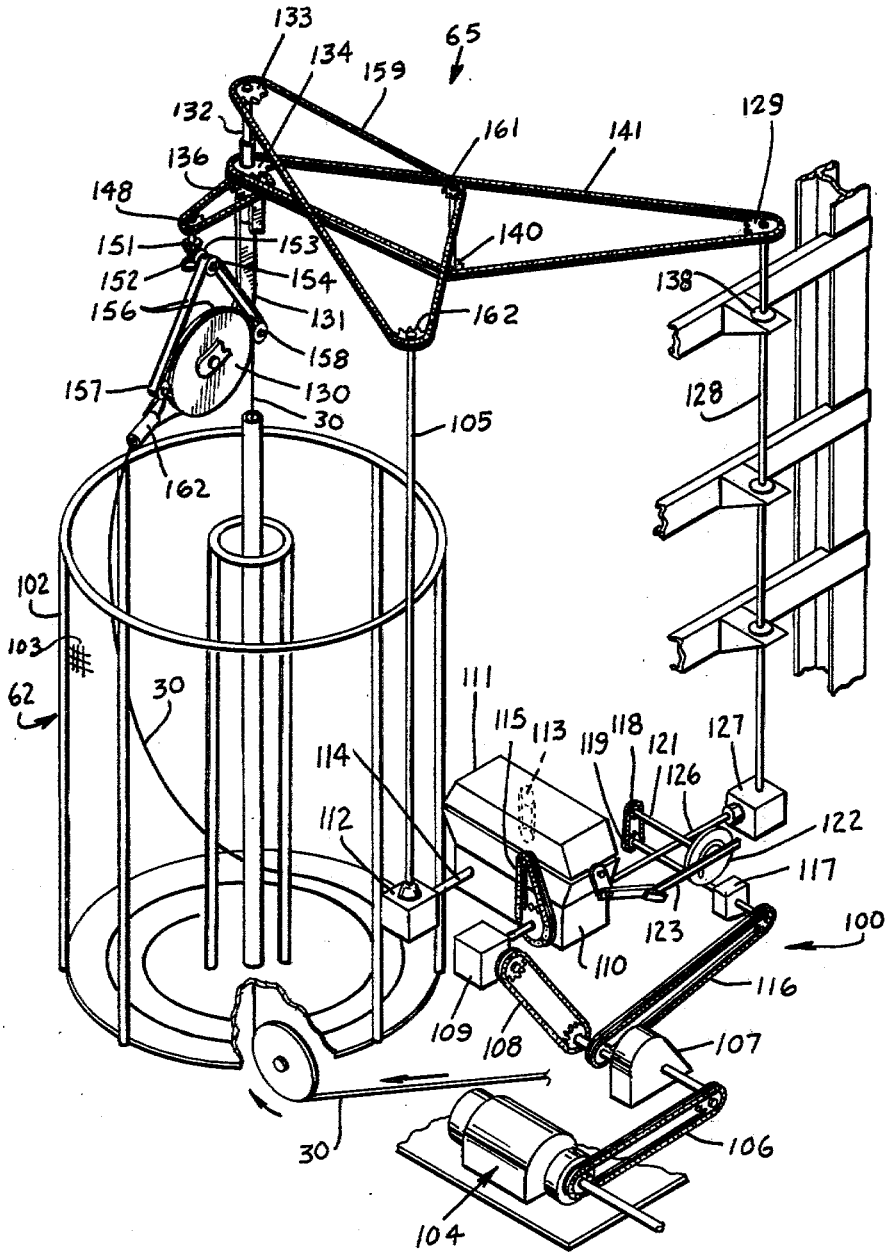
FIG. 7 is a perspective view of a portion of the apparatus of FIG. 1 for taking up a plurality of convolutions of the cable unit.

Considering now the manufacture of only a single unit 30 by one of the ROL devices 55—55 in FIG. 1, the gathered layers of conductor pairs are taken up for subsequent use in stranding or cabling operations. Turning now to FIG. 7, there is shown the takeup 60, which includes the closed or open sided container 62 that is stationary during takeup and which may include vertical posts 102—102 with wire mesh 103 thereabout or may include a solid side wall (not shown). It is to be understood that the takeup 60 is also used for a multiunit 50 with the same operation as that to be described for the single unit 30.

The takeup 60 includes a system 100 which controls the deposition of the convolutions or loops of the unit 30 or multi-unit 50 in the container 62 while maintaining line speed of the unit. The system 100 includes a motor 104 that turns at line speed and that is connected through a belt 106 to a reducer 107.

The reducer 107 is connected through a belt 108 to a right angle gear box 109 which provides a direct input to a differential unit 110, and to a positive infinitely variable transmission 111 (hereinafter referred to as "PIV" transmission) through a belt 115. The differential unit may be one such as that marketed commercially by Fairchild Industrial Products Division under the trade name "Specon" while the PIV transmission may be one such as horizontal model TD-44 also marketed by Fairchild. An output shaft of the PIV transmission 111 is connected by belting 113 and a shaft 114 to right angle gear box 112 which turns a vertically disposed flyer head input drive shaft 105.

The reducer 107 also drives a belt 116, turns a gear unit 117 to turn two coupled pulleys 118 and 119, and rotates shaft 121 which inputs the PIV transmission 111 through a cam 122 and linkage 123. The cam 122 is programmed through a predetermined contour so that it is effective to control the diameter of the loops or convolutions of the unit 30 which are deposited in the container 62. The differential unit 110 also has a shaft 126 extending therefrom to a right angle gear box 127 which turns a vertically disposed capstan input drive shaft 128 and attached sprocket 129.

The unit 30 or multi-unit 50 which is deposited in each layer is caused to generally follow an Archimedes spiral. Because of this pattern pattern of distribution, the speed of revolution of the flyer capstan 65 cannot be changed linearly; rather, the cam 122 is constructed with a contour which changes the speed as the deposition proceeds inwardly and outwardly in each layer within the container 62. An infinite range of speed changes as predetermined by the contour of the cam 122 can be accommodated by the PIV transmission 111.

The differential unit 110 is designed so that the line speed of the unit 30 and the speed of revolution of the flyer capstan 65 are inputs thereto. The output of the differential unit 110 is that speed in RPM which is necessary to pull the cable unit 30 through the apparatus 29 at a constant speed while the flyer input shaft 105 changes its rotational speed to obtain the sequentially increasing and decreasing size loops in each layer 66.

Figures 8, 8A:
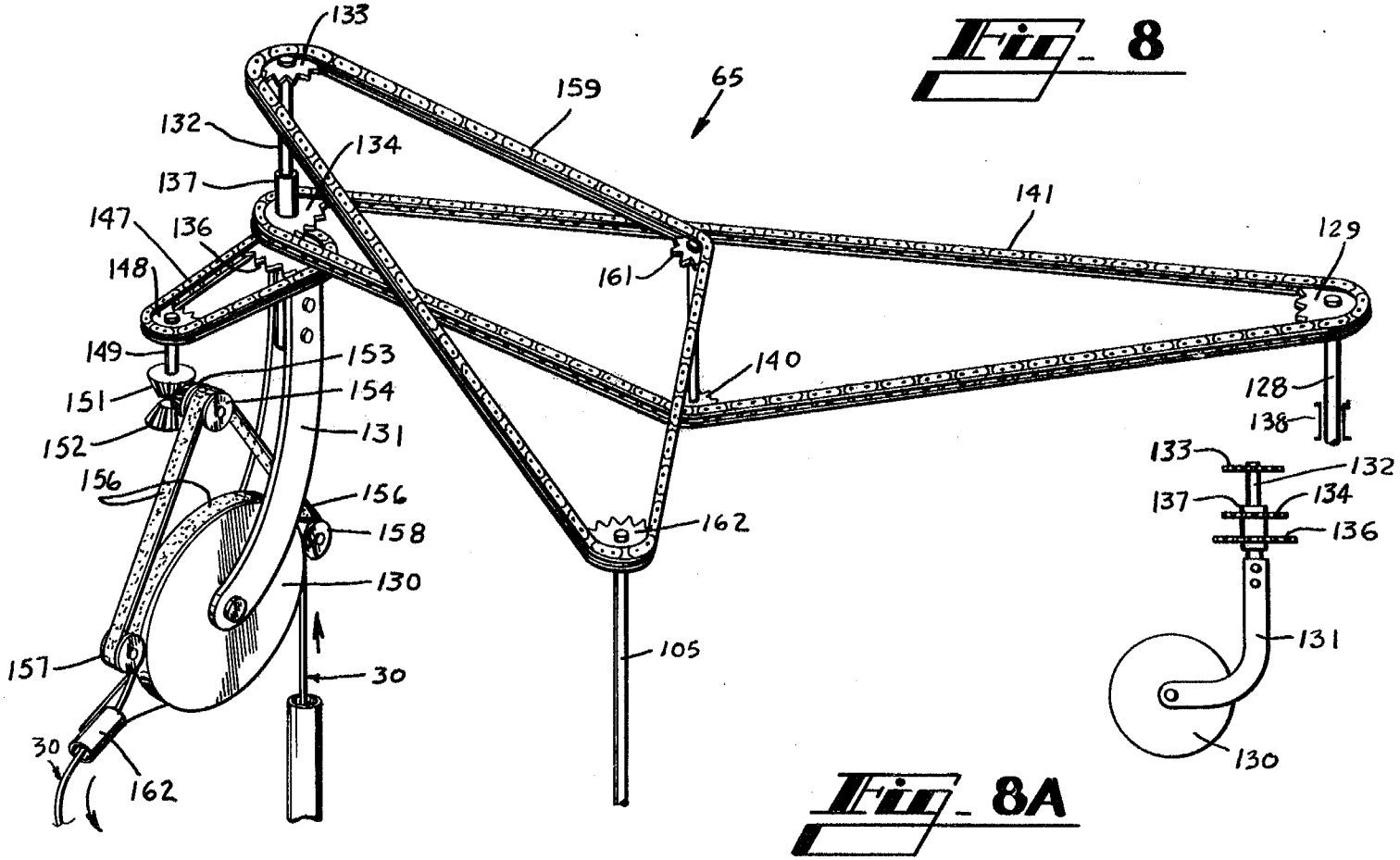
FIG. 8 is an enlarged perspective view of a portion of the apparatus shown in FIG. 7.
FIG. 8A is an enlarged view of a portion of the apparatus which is shown in FIG. 8.

Viewing now FIGS. 8 and 8A, there is shown the flyer-capstan 75 for causing successive increments of the cable unit 30 or the multi-unit 50 to be deposited in a predetermined pattern in the container 62. The flyer-capstan 65 includes a capstan sheave 130 which is rotated about its axis by a drive train which extends from the shaft 128 to advance successive increments of the unit 30 or multi-unit 50. The capstan sheave 130 is also caused to revolve about the vertical axis of the container 62 by a drive train which extends from the shaft 105 to cause the unit 30 or the multi-unit 50 to be deposited in layers in a predetermined pattern.

The capstan wheel 130 is supported rotatably on a pin which extends between a pair of downwardly depending arms 131—131 which straddle the wheel and which are attached to flyer-capstan shaft 132 that has a sprocket 133 attached to an upper end thereof. Sprockets 134 and 136 are connected together and mounted on a bearing assembly 137, which is rotatable independently, but coaxially with, the flyer shaft 132.

Going now to the drive train for advancing the unit 30 around the capstan wheel 130, the capstan input drive shaft 128 which controls the advance of the unit 30 has an upper portion supported in a bearing 138 and has the sprocket 129 attached to the upper end thereof. A drive chain 141 passes around the sprocket 129, around a tensioning sprocket 140 and then around the sprocket 134. The driving of the capstan 65 is accomplished through a chain 147 that passes around a sprocket 148 to drive a shaft 149 to turn bevel gears 151 and 152. These bevel gears turn a gear 153 to turn a pulley 154 over which passes a belt 156. The belt 156 passes around pulleys 157 and 158 and is caused by these pulleys to engage a predetermined portion of the periphery of the capstan wheel 130.

The drive train for revolving the capstan sheave 130 includes a chain 159 that passes around a tensioning sprocket 161 and a sprocket 162 that is attached to an upper end of the previously mentioned flyer head input drive shaft 105. The programmed cam 122 controls the turning of the shaft 105 to control the shaft 132 and hence the revolution of the capstan wheel 130 to achieve a predetermined pattern of loops in each layer in the container 62.

As is seen in FIG. 8, successive increments of the length of the unit or the multi-unit 50 emerge from the center well of the container 62 and are passed between the belt 156 and the wheel 130 to be directed out of a feed tube 162 which is supported from the arms 131—131.

The above-described arrangement provides a differential drive for the capstan 65 and a constant speed for the cable unit 30 or the multi-unit 50. This facilitates the change in the size of the loops being deposited which permits a layering and results in a dense package without changing the speed of the cable unit through the apparatus.

Figure 9:
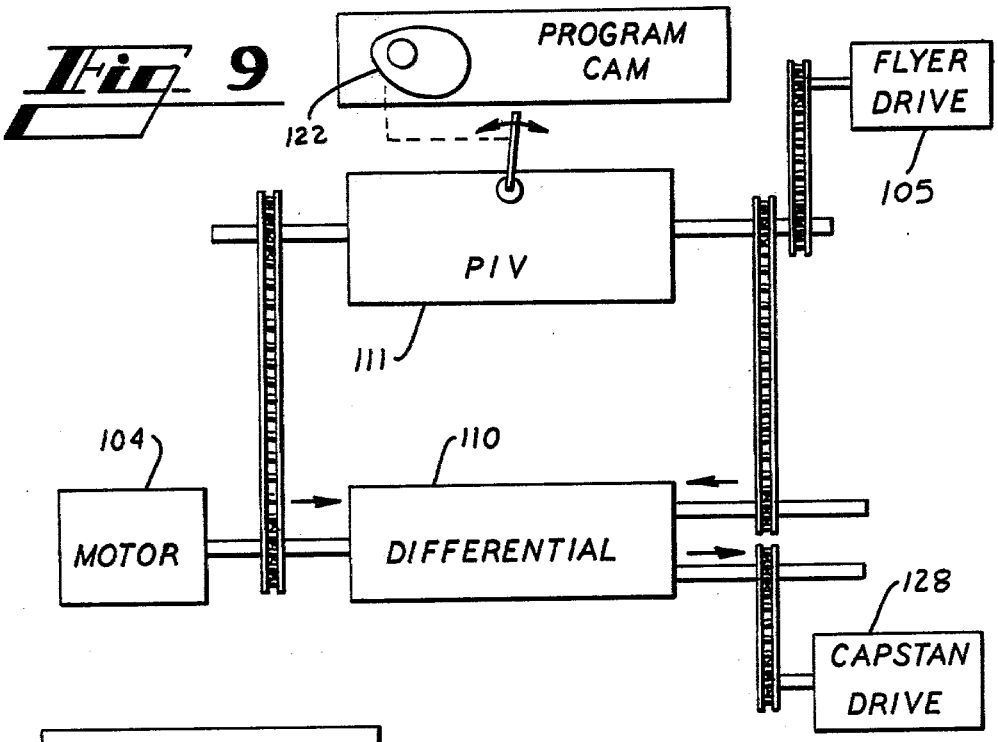
FIG. 9 is a preferred embodiment of a drive system which is used to control and move the takeup system shown in FIG. 7.

Referring now to FIG. 9 there is shown a schematic view of the system 100, for controlling the deposition of convolutions of the cable unit 30 or the multi-unit 50 in the container and for maintaining the line speed of the unit substantially constant. This view schematically shows the system which is used to drive the capstan 65 and to revolve the capstan 130 about the vertical axis through the container 62.

As is seen in FIG. 9, the motor 104 inputs the differential unit 110 as well as the PIV transmission 111. The PIV transmission 111 which is modulated by the programmable cam 122, inputs and controls the operation of the flyer drive shaft 105 to turn the shaft 132 and revolve the flyer-capstan 65 about the vertical axis of the container 62. This is accomplished independently of the capstan drive shaft 128 which is controlled by an output of the differential unit 110. However, as should be apparent from FIG. 9, an output of the PIV unit 111 is fed into the differential unit 110 together with an input of the motor 104 which controls the capstan drive shaft 128 to maintain a constant line speed notwithstanding changes in the speed of revolution to deposit varying size loops in accordance with the predetermined pattern.

Figure 10:
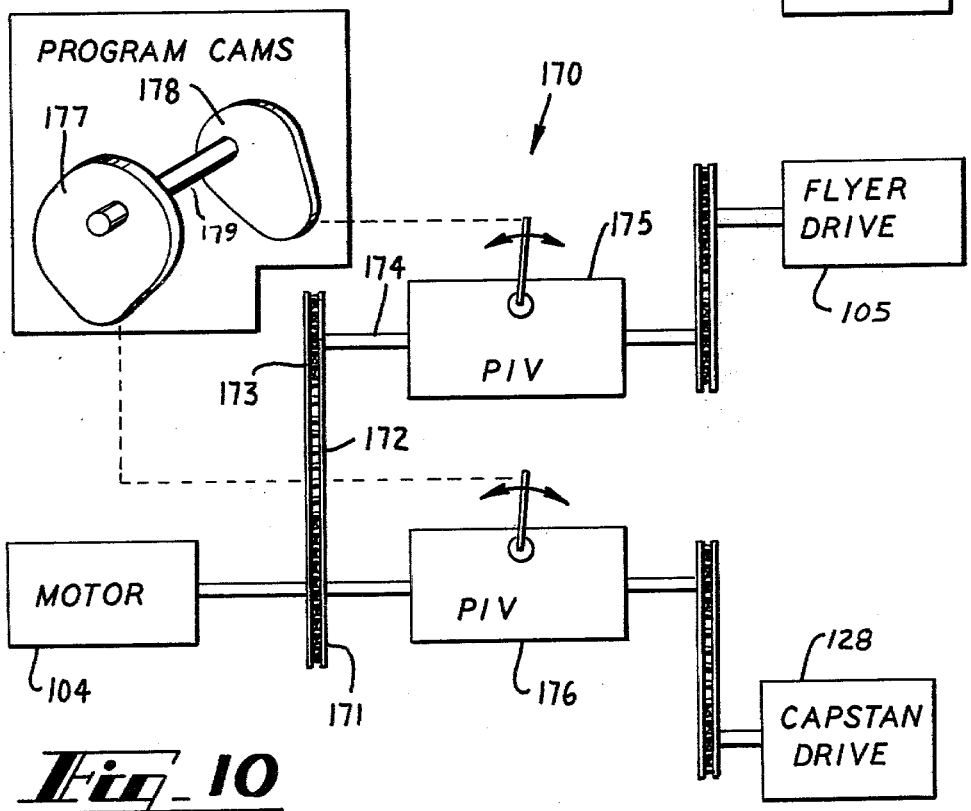
FIG. 10 is an alternate embodiment of a drive system for controlling and moving the takeup system.

In an alternate embodiment 170 shown in FIG. 10, the motor 104 turns a sprocket 171, and turns a chain 172 mounted about a second sprocket 173 which is attached to a shaft 174 extending from a first PIV unit 175. The motor 104 also inputs a second PIV unit 176 which outputs to the capstan drive shaft 128 while the first PIV unit outputs to the flyer drive 105. The PIV units 175 and 176 are modulated by programmable cams 177 and 178 mounted on a common shaft 179.

Testing reverse oscillated layer cable units 30—30 or multi-units 50—50 may be conducted as they are made by this invention. The testing is accomplished by connecting a test set 180 (see FIG. 1) to an initially deposited end of the unit 30 in the takeup container 62 with high voltage electrodes 181—181, which spark over, being positioned between the supply stands 51—51 and the ROL devices 55—55.

While the preferred embodiment of the invention has been described in terms of a cable unit 30 or a multi-unit 50 being moved to a point below the container 62 and then upwardly, it is within the scope of this invention to move the units from the ROL device 55 directly overhead to the system 60 and deposit them in the container. This would result in the unit 30 in the container having a lay in one direction so that when it is withdrawn, a lay of an opposite direction is imparted thereto to cancel out the original lay. The unit 30 as moved through a strander cabler or a cabler (not shown) would have a final lay of one direction imparted thereto.

As will be recalled, the unit 30 or multi-unit 50 which is comprised of a plurality of units 30—30 is subsequently withdrawn from the container 62, a unidirectional stranding lay imparted thereto, and then it is formed into a completed cable with such additional steps, as for example, jacketing.

Figures 11, 12, 13:
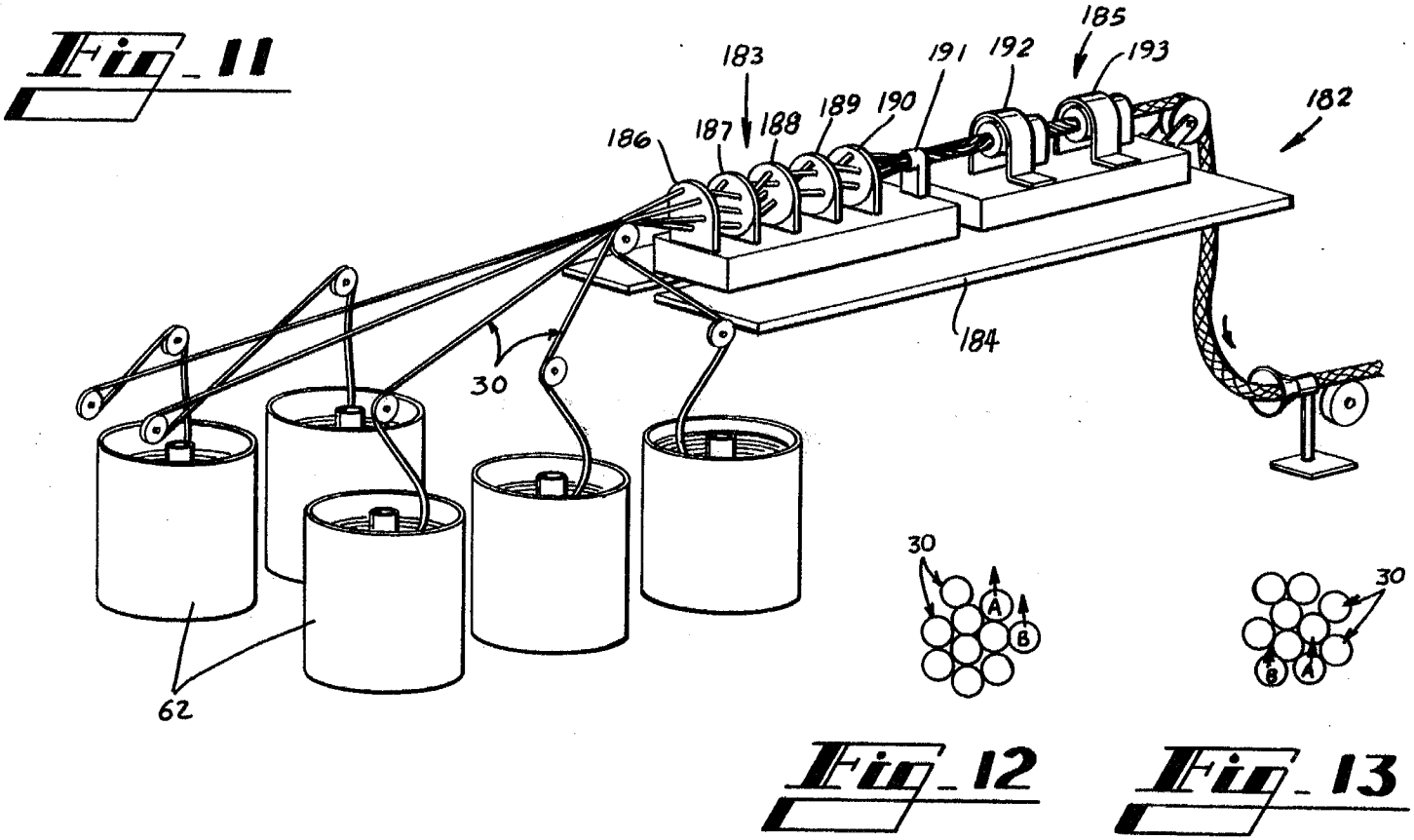
FIG. 11 is a perspective view of an apparatus into which are fed a plurality of units or multi-units made by apparatus of this invention and which forms the units or multi-units into a cable core.
FIGS. 12 and 13 are cross sectional views of the cable core which is made with the apparatus of FIG. 11 and taken at spaced points along the core.

For some size cables, a plurality of units 30—30 or a plurality of multi-units 50—50 in containers are supplied to an apparatus designated generally by the numeral 182 (see FIG. 11) for assembling the units into a core which is subsequently jacketed. The apparatus 182 includes an oscillation station 183 and a binding station 185 which are mounted on a frame 184.

The oscillation station 183 includes a stationary entrance plate 186 and a plurality of spaced faceplates 187, 188, 189 and 190, each of which includes a plurality of openings and each of which is mounted for oscillating motion. The number of angularly oscillatory mounted faceplates which are required between the fixed plate 183 and the final oscillating plate is a function of the angle of oscillation of the latter since the maximum angle of oscillation of each oscillating plate relative to the preceding plate must be less than ±90° if rubbing of the strand elements being passed therethrough at a point between the plates is to be avoided. For a discussion of this problem, see for example, U.S. Pat. No. 3,572,024. Therefore, the plate 187 is mounted to oscillate 90° in one direction, then 90° in another direction; the plate 188, 180° in each direction; the plate 189, 270° in each direction, and finally the plate 190, 360° in each direction. This may be accomplished in an expanded arrangement of that shown in FIG. 3 in which the shaft 74 drives all of the faceplates but through gearing having successively changed teeth arrangements in order to achieve the required angular oscillations.

After the units 30—30 or multi-units 50—50 emerge from the openings in the last plate 190, they are passed through gathering dies 191—191 which size the assembly into a core. Then the core is passed through binder heads 192 and 193 in the binding station 185 which bind the core in opposite directions in preparation for subsequent shielding and jacketing operations.

It should be noted that as the units 30—30 or the multi-units 50—50 are advanced through the apparatus 182, they are caused to have a periodically reversed lay. However, this is accomplished in a way, which is referred to as the floating carriage technique in drum stranding, such that the unidirectional lay of the conductors pairs is maintained. Comparing FIGS. 12 and 13, it can be seen that, although the units in the final cable core have a periodically reversed lay, the circular orientation of each unit or multiunit with respect to its longitudinal axis is not changed.

While the invention has been described in terms of making a cable unit 30, it should also be apparent that the system 29 could be used to distribute other strand elements such as, for example, copper rod into a stationary container in a dense package which comprises a plurality of layers each having varying size loops. This would avoid the need to use oscillating type motion for a rod-takeup container as well as eliminate the need for moving containers of substantial mass.

It is to be understood that the above-described arrangements are simply illustrative of the invention. Other arrangements may be devised by those skilled in the art which will embody the principles of the invention and fall within the spirit and scope thereof.

What is claimed is:

1. A method of making cable, said method comprising the steps of:

advancing each of a plurality of conductors through an associated guide of a plurality of spaced guides which are arranged about a common axis;

reciprocally rotating said guides about said common axis;

gathering said conductors together into a unit;

moving the unit to a distribution plane above a stationary takeup container;

directing successive increments of the unit downwardly into the container and causing the unit to be deposited in a predetermined pattern within the container; while maintaining a substantially constant speed at which the unit is moved.

2. The method of claim 1, wherein said guides are arranged in a plurality of layers with said guides in each layer being formed by a plurality of openings in an associated one of a plurality of concentrically disposed plates and with adjacent ones of said plates being oscillated by reciprocal rotation through predetermined angles in alternately opposite rotary directions about said common axis.

3. The method of claim 2, wherein a lay of one direction is imparted to each of the layers as the unit is directed downwardly into the container.

4. The method of claim 1, wherein the unit is deposited in successive increments of height within the container with each increment of height in said container comprising a plurality of adjacent convolutions of successively varying size.

5. The method of claim 2, wherein the angle through which each of said concentrically disposed plates is oscillated is different from that of at least one adjacent layer.

6. The method of claim 1, in which each of said conductors comprises a twisted pair of insulated conductors and in which a lay of one direction is imparted to the conductor pairs of the unit as it is moved to the distribution plane and a lay of an opposite direction is imparted to the conductor pairs of the unit to cancel the lay in the one direction as the unit is directed downwardly into the container.

7. The method of claim 6, which also includes the steps of:

withdrawing successive increments of the unit from said container and imparting a stranding lay to the conductor pairs of the unit; and enclosing the unit in a jacket of plastic material.

8. The method of claim 1, wherein each of said conductors comprises a twisted insulated conductor pair and each of the twisted pairs has a unidirectional lay about a longitudinal axis of the unit, said method also including the further steps of advancing a plurality of the units in a plurality of concentrically disposed layers and periodically reversing the lay of the units in each layer without changing the circular orientation of the twisted conductor pairs within each of said units with respect to a longitudinal axis of each of said units.

9. The method of claim 4, wherein the unit is deposited into said container from a flyer-capstan which is revolved about a vertical axis of said container with the velocity of revolution of said flyer-capstan being controlled to provide said varying size convolutions.

10. The method of claim 6, wherein the conductor pairs of the unit are caused to have a lay of one direction imparted thereto by moving the cable unit to a point below said container and then upwardly to said distribution plane.

11. An apparatus for making cable, said apparatus comprising:

a plurality of spaced guides which are arranged in a predetermined pattern about a common axis;

means for advancing each of a plurality of conductors through an associated one of the guides;

a stationary container;

means for reciprocally rotating said plurality of guides about said common axis;

means for gathering the conductors together into a unit;

means for moving the unit to a distribution plane above the stationary takeup container;

means for directing successive increments of the unit downwardly into the container and for causing the downwardly moving unit to be deposited in a predetermined pattern within the container; and means for causing the speed at which the unit is moved to be maintained substantially constant.

12. An apparatus for making cable, said apparatus comprising:

a plurality of plates which are concentrically disposed about a common axis, each of said plates including a plurality of circumferentially disposed openings;

means mounting said plates for reciprocal rotation about said axis such that adjacent plates are oscillated in opposite rotary directions;

means for reciprocally rotating each of said plates through a predetermined angle;

means for advancing a twisted conductor pair through each of said openings with conductor pairs being advanced through each plate comprising a layer;

means for gathering the layers into a unit having a generally circular configuration;

a stationary container for receiving the unit;

means for moving the unit to a distribution plane above said container;

means for causing the unit to be deposited in successive increments of height within the container with the unit in each of the increments of height following a predetermined pattern; and means for maintaining a substantially constant speed at which the unit is moved.

13. The apparatus of claim 12, wherein said means for depositing the unit in said container causes each of the increments of height to comprise a plurality of adjacent convolutions of successively varying size.

14. The apparatus of claim 12, wherein said means for reciprocally rotating said plates causes adjacent plates to be oscillated in reverse rotary directions with adjacent plates rotated through different angles.

15. The apparatus of claim 12, wherein said means which move said successive increments of the unit to said distribution plane causes a lay of one direction to be imparted to the unit and wherein said means which causes successive increments of the unit to be deposited in said container causes a lay of an opposite direction to be imparted to the unit to cancel out the lay in the one direction.

16. The apparatus of claim 12, which also includes:

means for withdrawing successive increments of the unit from the container and for imparting a stranding lay thereto; and means for enclosing the unit in a plastic jacket.

17. An apparatus for making reverse oscillated layer cable, said apparatus comprising:

a plurality of concentrically disposed faceplates each of which includes a plurality of circumferentially disposed openings through each of which said openings a twisted pair of conductors is capable of being advanced with the conductors being advanced through each plate comprising a layer;

means mounting said faceplates for reciprocal rotation such that adjacent faceplates are capable of being oscillated in reverse rotary directions;

means for reciprocally rotating said faceplates;

means for assembling the layers into a unit having a generally circular configuration;

means for binding the unit;

a stationary container for receiving the unit;

means for moving the unit to a distribution plane above said container while imparting a lay of one direction to the unit;

means for causing the unit to be deposited in successive increments of height within the container and for imparting a lay of an opposite direction to cancel out the lay in said one direction, said means including means for causing the unit to be moved at a substantially constant speed;

means for withdrawing successive increments of the unit from the container and for imparting a stranding lay thereto; and means for enclosing the unit in a plastic jacket.

18. The apparatus of claim 17, wherein said means for depositing the unit causes each increment of height to comprise a plurality of adjacent convolutions of successively varying size.

19. The apparatus of claim 17, wherein means for depositing the unit includes:

a flyer head which includes a capstan;

means mounting said flyer head for revolution about a vertical axis of said container; and means for revolving said flyer head about said axis at speeds which are varied to cause a controlled deposition of convolutions of the unit.

20. The apparatus of claim 17, wherein said lay-causing means includes means for causing the unit to be moved to a point below said container and then upwardly to said distribution plane.

* * * * *